US006636612B1

(12) United States Patent
North et al.

(10) Patent No.: US 6,636,612 B1
(45) Date of Patent: Oct. 21, 2003

(54) SPEAKER FOR USE IN CONFINED SPACES

(75) Inventors: Donald J. North, Los Angeles, CA (US); Dai Z. Lee, Torrance, CA (US)

(73) Assignee: Algo Sound, Inc., El Segundo, CA (US)

( * ) Notice: Subject to any disclaimer, the term of this patent is extended or adjusted under 35 U.S.C. 154(b) by 203 days.

(21) Appl. No.: 09/706,145

(22) Filed: Nov. 3, 2000

(51) Int. Cl.[7] ..... H04R 25/00

(52) U.S. Cl. ..... 381/412; 381/397; 381/398

(58) Field of Search ..... 381/396, 397, 381/398, 403, 412, 420

(56) References Cited

U.S. PATENT DOCUMENTS

| | | | | | |
|---|---|---|---|---|---|
| 3,783,311 | A | * | 1/1974 | Sato et al. | 310/27 |
| 4,595,801 | A | * | 6/1986 | Coffin | 181/163 |
| 5,155,773 | A | * | 10/1992 | Hansen | 381/194 |
| 5,321,762 | A | * | 6/1994 | Stuart | 381/420 |
| 5,471,437 | A | * | 11/1995 | Schutter et al. | 367/175 |
| 5,536,984 | A | * | 7/1996 | Stuart et al. | 310/13 |
| 5,727,076 | A | * | 3/1998 | Paddock | 381/174 |
| 5,729,617 | A | * | 3/1998 | Gruber | 381/412 |
| 5,768,395 | A | * | 6/1998 | Stuart et al. | 381/396 |
| 5,786,741 | A | * | 7/1998 | Leibzon | 335/222 |
| 5,894,263 | A | * | 4/1999 | Shimakawa et al. | 340/388.1 |
| 5,898,786 | A | * | 4/1999 | Geisenberger | 381/412 |

FOREIGN PATENT DOCUMENTS

| | | | | |
|---|---|---|---|---|
| JP | 6-14393 | * | 1/1994 | 381/412 |
| JP | 6-54398 | * | 2/1994 | 381/412 |
| JP | 6-292296 | * | 10/1994 | 381/412 |
| WO | WO 93/03586 | * | 2/1993 | 381/412 |
| WO | WO 94/18806 | * | 8/1994 | 381/312 |

* cited by examiner

*Primary Examiner*—Curtis Kuntz
*Assistant Examiner*—P. Dabney
(74) *Attorney, Agent, or Firm*—Blakely, Sokoloff, Taylor & Zafman

(57) ABSTRACT

The invention provides a speaker having a number of features that cooperate to provide a small speaker 10 having a high sound pressure level output capability (volume), a wide frequency range, in particular from below 200 Hz to 20,000 Hz, low distortion, and that is magnetically shielded. The speaker 10 is suitable for mounting in, for example, a television where spaces are confined and stray magnetic fields are undesirable, yet high output is desirable and a wide frequency range is desirable to avoid the need for separate middle frequency (midrange) and high frequency (tweeter) speakers.

17 Claims, 5 Drawing Sheets

SPEAKER FOR USE IN CONFINED SPACES

BACKGROUND OF THE INVENTION

1). Field of the Invention

This invention relates to a speaker.

2). Discussion of Related Art

It is often required that a speaker be mounted in, for example, a housing of a computer monitor or a housing of a television set. These housings generally do not provide space for large speakers. Speakers having magnetic fields leaking therefrom are preferably avoided due to the possibility of interference with a cathode ray tube. Ideally, such a speaker has a high sound pressure level output capability (volume), a wide frequency range, and low distortion.

SUMMARY OF THE INVENTION

The invention provides a speaker comprising a casing, a pole piece, a substantially circular magnetic structure, a diaphragm, a suspension mechanism, and an electric coil.

The casing has an inner surface and an outer surface. The pole piece is located within the casing. The pole piece has an outer surface, and an inner surface defining a venting passage therethrough. A substantially annular gap is defined between the inner surface of the casing and the outer surface of the pole piece.

The magnetic structure is located within the annular gap. The magnetic structure is radially polarized so as to have a first polarity on an inner surface and a second polarity on an outer surface so as to create a line of magnetic flux following a loop sequentially from the outer surface of the magnetic structure to the casing, from the casing to the pole piece, and from the pole piece to the inner surface of the magnetic structure.

The casing, the pole piece, and the magnetic structure are mounted to one another to form a magnet assembly which defines an annular coil gap with the path of the line of magnetic flux being across the coil gap.

The suspension mechanism has a first portion attached to the magnet assembly and a second portion attached to the diaphragm so as to mount the diaphragm to the suspension mechanism. The suspension mechanism allows for travel of the diaphragm relative to the magnet assembly. The diaphragm and the suspension mechanism jointly define an enclosure.

The coil is located in the coil gap and has a portion connected to the diaphragm so that an electric current in the coil causes movement of the diaphragm. Movement of the diaphragm causes movement of air through the venting passage between the enclosure and externally of the magnet assembly.

The travel of the diaphragm is preferably at least 0.1 times a diameter of the diaphragm in order to provide sufficient sound output.

The diaphragm preferably has a dome shape for sufficient stiffness at high frequencies.

The venting passage is preferably at least 0.5 times as wide as a diameter of the coil to ensure sufficient venting of air.

The venting passage is preferably at least 0.5 times as wide as a width of the diaphragm to ensure sufficient venting of air.

The electric coil preferably has a diameter that is at least 0.5 times as wide as the diaphragm in order to maximize the amount of force that can be generated when current flows through the coil.

A ratio of a length of the coil to a length of the coil gap preferably falls outside of the range of from 0.67 to 1.5 so as to allow for the travel to be sufficiently large without causing distortion. The ratio is preferably less than 0.67 so that the travel is relatively large thereby ensuring that the coil remains within the coil gap and so preventing distortion, while still minimizing coil mass and inductance.

BRIEF DESCRIPTION OF THE DRAWINGS

The invention is further described by way of example with reference to the accompanying drawings wherein.

DETAILED DESCRIPTION OF THE INVENTION

Figure 1:
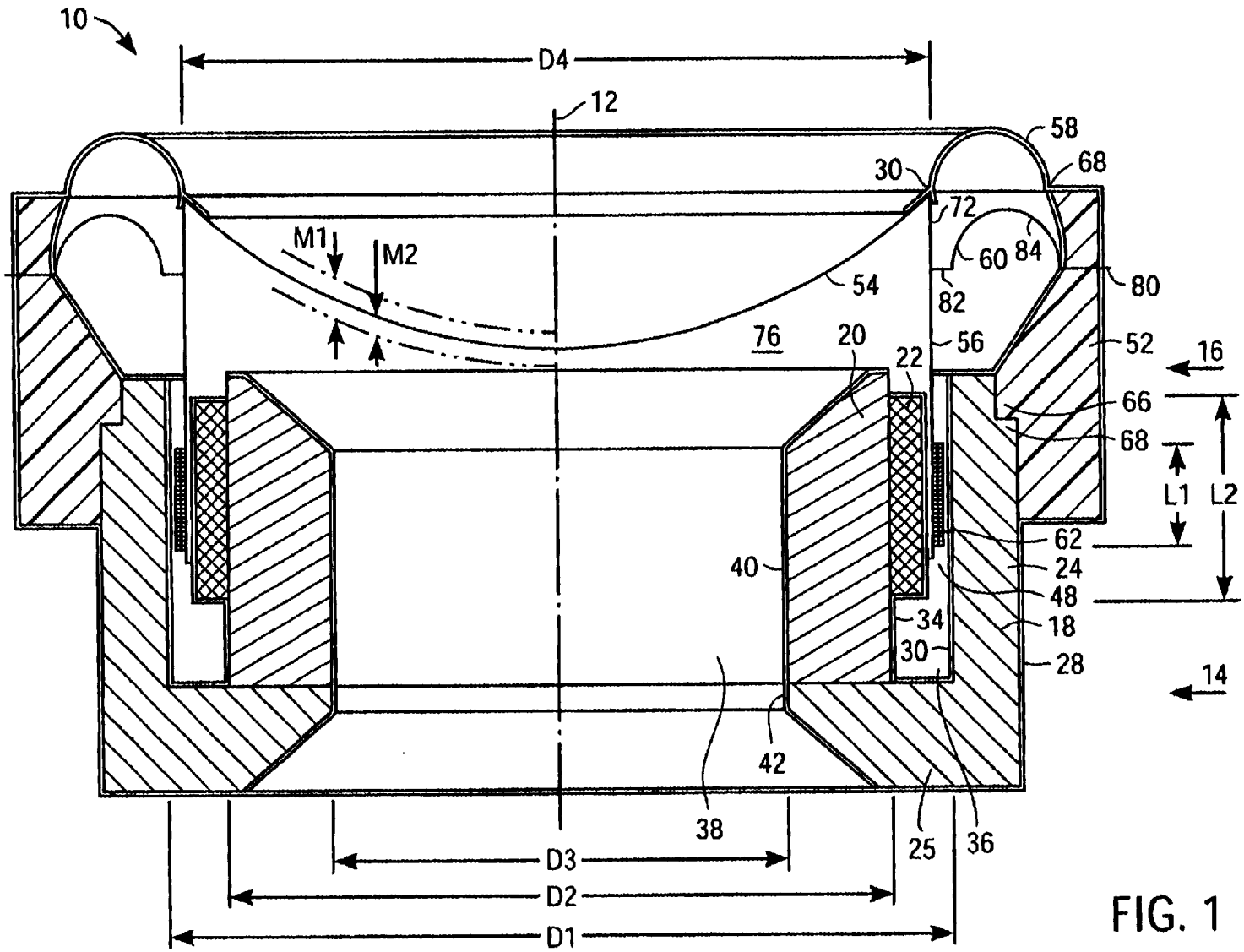
FIG. 1 is a cross-sectional side view of a speaker according to an embodiment of the invention.

FIG. 1 of the accompanying drawings illustrates a speaker 10 according to an embodiment of the invention. A number of features that cooperate to provide a small speaker 10 having a high output (volume), a wide frequency range, in particular from below 200 Hz to 20,000 Hz, has low distortion, and is magnetically shielded. The speaker 10 is suitable for mounting in, for example, a computer monitor where spaces are confined, stray magnetic fields are undesirable, yet high output is desirable and a wide frequency range is desirable to avoid the need for separate middle frequency (midrange) and high frequency (tweeter) speakers, which physically require more space.

All the components of the speaker 10, except individual magnets, are annular. Each component has a center axis that falls on a long axis 12. The speaker 10 includes two main subassemblies, namely a lower magnet assembly 14, and an upper diaphragm assembly 16.

The magnet assembly 14 includes a casing 18, a pole piece 20, and a plurality of magnets 22.

The casing 18 includes an outer wall 24 and a base 26 extending radially inward from a lower end of the outer wall 24. The outer wall 24 has an outer surface 28 and an inner surface 30. The inner surface 30 has a diameter D1 of 34 mm.

The pole piece 20 is inserted into the outer wall 24 and has a lower surface resting on the base 26. The pole piece 20 has an outer surface 34 having a diameter D2 of 30 mm. An annular gap 36 is defined between the inner surface 30 of the outer wall 24 and the outer surface 34 of the pole piece 20.

A venting passage 38 is formed through the pole piece 20 and the base 26. The venting process 38 is thereby partially defined by an inner surface 40 of the pole piece 20 and an inner surface 42 of the base 26. The inner surfaces 40 and 42 have diameters D3 of 20 mm. The entire venting passage extends in a direction of the long axis, a feature hereinafter referred to an "axial vent".

Figure 2:
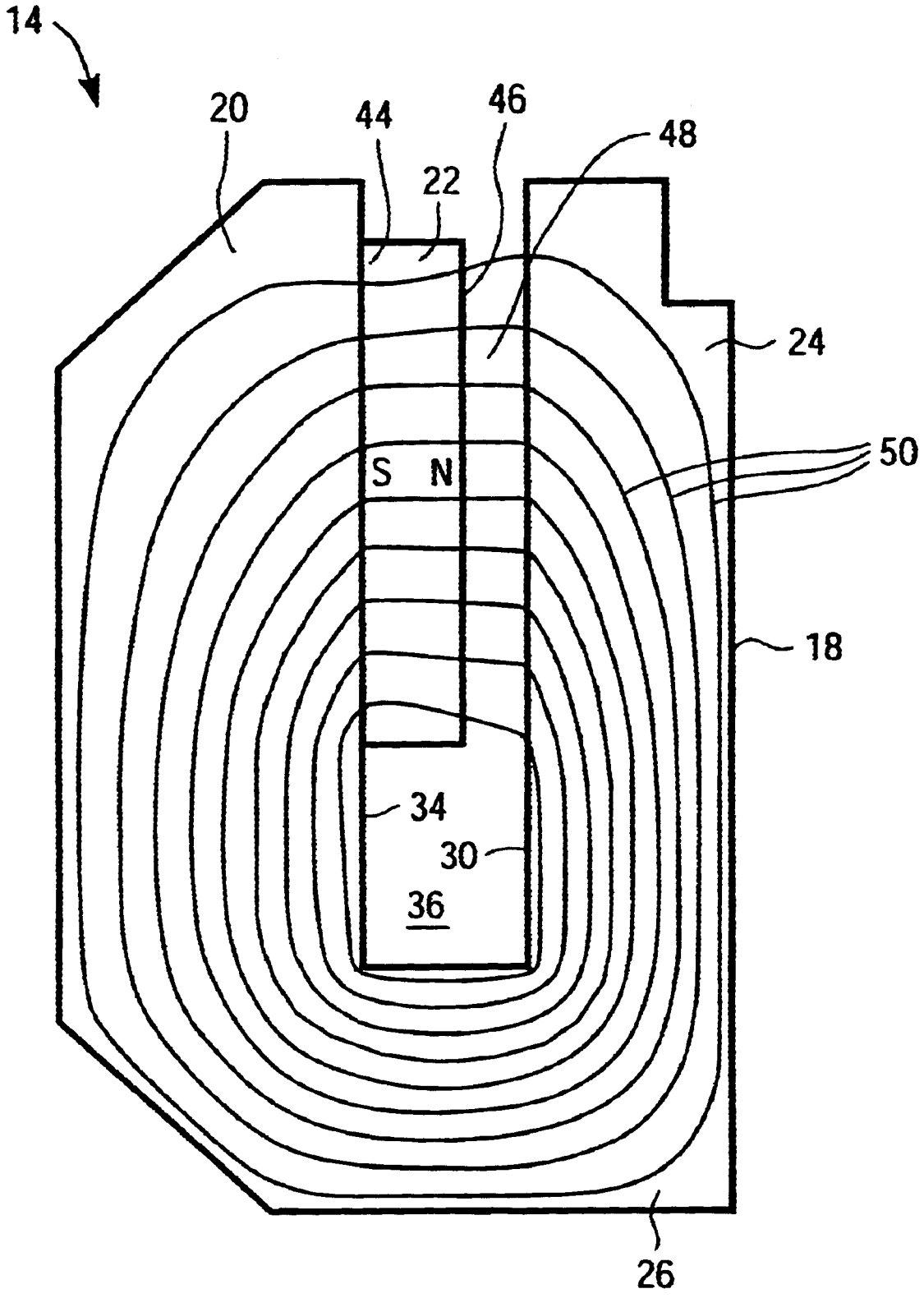
FIG. 2 is a cross-sectional side view of portions of the speaker.

The magnets 22 are attached to the outer surface 34 of the pole piece 20. FIG. 2 illustrates the pole piece 20, the magnets 22, and the casing 18 in more detail. Each magnet 22 has an inner surface 44 against to the outer surface 34 of the pole piece 20, and an outer surface 46. The magnet 22 is polarized so that south is at the inner surface 44 and north is at the outer surface 46. Together, the magnets 22 form a magnetic structure around the pole piece 22 and within the annular gap 36, the magnetic structure being radially polarized so that an inner surface of the magnetic structure has a first polarity, namely south, and an outer surface of the magnetic structure has a second polarity, opposing the first polarity, namely north.

A coil gap 48 is defined between the outer surface 46 of the magnetic structure and the inner surface 30 of the outer wall 24. The coil gap 48 is as long as one of the magnets 22. Each magnet 22 creates a magnetic field with lines of magnetic flux, each following a closed loop 50. The closed loop 50 is from the outer surface 46 of the magnet 22 across the coil gap 48, to the inner surface 30 of the outer wall 24, down the outer wall 24, inwardly through the base 26, from the base 26 into a lower portion of the pole piece 20, up through the pole piece, and out through the outer surface 34 of the pole piece 20 to the inner surface 44 of the magnet 22. There is no leakage of the magnetic field outside the magnet assembly 14, and in particular no leakage of the magnetic field in an area surrounding the outer wall 24 of the casing 18. There is thus substantially no magnetic flux leakage in an outer one of the closed loops 50 around an outer surface of the casing. Moreover, there is substantially no magnetic flux leakage in an inner one of the closed loops 50 within the annular gap below the magnets 22. The lines of magnetic flux would follow the same paths should the magnets be turned around so that north is on the inside.

Referring again to FIG. 1, the diaphragm assembly 16 includes a frame 52, a dome shape diaphragm 54, and annular bobbin 56, a surround suspension 58, a spider suspension 60, and an electric coil 62.

The frame 52 is made of a non-magnetic material such as plastic or aluminum. Complementary formations 66 and 68, respectively on the frame 52 and the outer wall 24 of the casing 18 interlock to bring the frame 52 into a stationery relationship relative to the magnet assembly 14.

The surround suspension 58 is in a half roll shape and has an outer edge secured to an upper periphery of the frame 52 and an inner edge 70 circumferentially secured to an outer edge of the diaphragm 54.

The surround suspension 58 is sufficiently compliant to allow for 4 mm of movement M1 of the diaphragm 54 in an upward direction from a neutral position, and 4 mm of movement M2 of the diaphragm 54 in a downward direction from the neutral position. The total travel of the diaphragm 54 is the sum of M1 and M2, namely 8 mm.

An upper end 72 of the bobbin 56 is also circumferentially secured to an outer edge of the diaphragm 54. Both the diaphragm 54 and the bobbin 56 have diameters D4 of 32.5 mm. The bobbin 56 extends from the diaphragm 54 downwardly into the coil gap 48. The coil 62 is wrapped around an outer surface of a lower end of the bobbin 56. The coil 62 has a length L1 in a direction of the long axis 12 which is about half as long as a length L2 of one of the magnets 22 in a direction of the long axis 12.

In use, an amplifier provides an oscillating electrical sound current to the coil 62. When current flows through the coil 62, a force is created on the coil 62 in a direction of the long axis 12. The force oscillates as the current in the coil 62 oscillates. The coil 62 has a diameter of 33 mm which is relatively large so that the entire length of the wire of the coil 62 is relatively long. Because of the relatively long wire of the coil 62, the force on the coil 62 is maximized. The length of the coil 62 in the direction of the long axis 12 is however relatively short in order to minimize the number of windings of the coil 62. By minimizing the number of windings, inductance created by the coil is minimized thereby allowing for the coil 62 to be driven to higher frequencies.

The force created by the coil 62 acts on the bobbin 56, which, in turn, deflects the inner edge 70 of the surround suspension 58. A spring force is created by the surround suspension 58 which tends to deflect the inner edge 70 in a direction opposite to the direction in which the bobbin 56 deflects in inner edge 70. When the force created on the bobbin 56 is larger than force created by the surround suspension 58, the inner edge 70 is deflected from its neutral position, which causes movement in the diaphragm 54. When the force on the bobbin 56 is reduced, the surround suspension 58 returns the diaphragm 54 to its neutral position.

Deflection of the diaphragm 54 causes movement of the coil 62 within the coil gap 48. The magnets 22 are sufficiently long to ensure that some of the coils 62 always remain within the coil gap 48 even when the diaphragm is maximally deflected, i.e. 4 mm to either side of its neutral position. Distortion of sound is thereby prevented. A high output of sound is allowed for because of relatively large deflection of the diaphragm 54 allowed for by the surround suspension 58 and because the coil 62 remains within the coil gap 48 even when the diaphragm is maximally deflected, i.e. 4 mm to either side of its neutral position.

An enclosure 76 is formed jointly by a lower surface of the diaphragm 56, an inner surface of the bobbin 56, upper surfaces of the magnets 22, and upper surfaces of the pole piece 20. Should air be trapped within the enclosure 76, alternating high and low pressures of the air would make the air act as a spring, which would drive the natural frequency of the diaphragm 54 and other parts moving therewith higher, thereby reducing the useable low frequency range.

Air is however allowed to flow via the venting passage 38 between the enclosure 76 and externally of the magnet assembly 14. The venting passage 38 is sufficiently large so as to minimize any high or low pressures within the enclosure 76, thereby allowing the speaker 10 to operate at frequencies as low as 130 Hz. A relatively large venting passage 38 is allowed for because the magnets 22 are relatively thin. As previously mentioned, there is no leakage of magnetic field from the casing 18. This is primarily due to the use of a radially magnetized magnetic structure. As such, the magnet assembly 14 is "self-shielded". Because of the self-shielded nature of the magnet assembly 14, there is no need to for large additional equipment around the casing 18 to contain the magnetic field. Because of the lack of such equipment, the casing 18 can be made relatively large, with a corresponding large coil 62, a large magnetic structure formed by the magnets 22, and a large venting passage 38 and, as mentioned, a large venting passage 38 allows for lower frequencies to be obtained.

It may be required to mount the speaker 10 in a board of a housing wherein the board surrounds the frame 52 and the casing 24. Because the venting passage 38 is an axial vent, the venting passage would not be blocked by such a board.

Low frequencies together with a large degree of travel (the sum of M1 and M2) may also cause rocking of the diaphragm 54 in a manner wherein its axis of symmetry pivots relative to the long axis 12. Such rocking may cause scraping of the bobbin 54 against the outer surface 46 of one of the magnets 22, or scraping of the coil 62 against the inner surface 30 of the outer wall 24 of the casing 18. Rocking is however minimized by the spider suspension 60. The spider suspension 60 has an outer periphery 80 secured to the frame 52, and an inner periphery 82 attached to the bobbin 56. A section 84 between the outer periphery 80 and the inner periphery 82 is has substantially the same profile as a profile of the surround suspension 58. Deformation of the section 84 allows for movement of the end 82 together with the bobbin 56. The spider suspension 60 provides an additional suspension for the bobbin 56 and the diaphragm 54 and, in use, prevents or minimizes rocking of the diaphragm 54. A reduction in rocking of the diaphragm 54 allows for lower frequencies to be obtained with a large degree of travel.

Although low frequencies can be obtained, frequencies as high as 20,000 Hz can also be obtained. As previously mentioned, one factor that allows for high frequencies that can be obtained is the use of relatively few windings in the coil 62. The use of a dome shape diaphragm 54 also allows for higher frequencies that can be obtained without bending or buckling of the diaphragm 54, as opposed to for example a cone shape diaphragm which may buckle or bend at high frequencies, all else being equal. High frequencies may also cause rocking of the diaphragm 54 in a manner wherein its axis of symmetry pivots relative to the long axis 12. Such rocking may cause scraping of the bobbin 54 against the outer surface 46 of one of the magnets 22, or scraping of the coil 62 against the inner surface 30 of the outer wall 24 of the casing 18. Rocking is however minimized by the spider suspension 60. The spider suspension 60 has an outer periphery 80 attached to the frame 52, and an inner periphery 82 attached to the bobbin 56. A section 84 between the outer periphery 80 and the inner periphery 82 has substantially the same profile as a profile of the surround suspension 58. Flexing of the section 84 allows for movement of the end 82 together with the bobbin 56. The spider suspension 60 provides an additional suspension for the bobbin 56 and the diaphragm 54 and, in use, prevent or minimize rocking of the diaphragm 54. A reduction in rocking of the diaphragm 54 allows for higher frequencies to be obtained.

It can thus be seen that a speaker 10 has dimensions that are relatively small, yet allows for a wide frequency range, in particular frequencies that are relatively low for a small speaker, which is magnetically shielded, and which provides high sound output.

In the descriptions of the embodiments that follow, for purposes of efficacy, not all details thereof are described and discussed in detail. Instead, the description of each of the embodiments that follow primarily indicates differences between the specific embodiment described and an embodiment or embodiments that have been described previously. Unless specifically stated otherwise or unless it can be inferred, therefore, it can be assumed that the details of subsequent embodiments are the same as details of embodiments that have been described previously.

Figure 3:
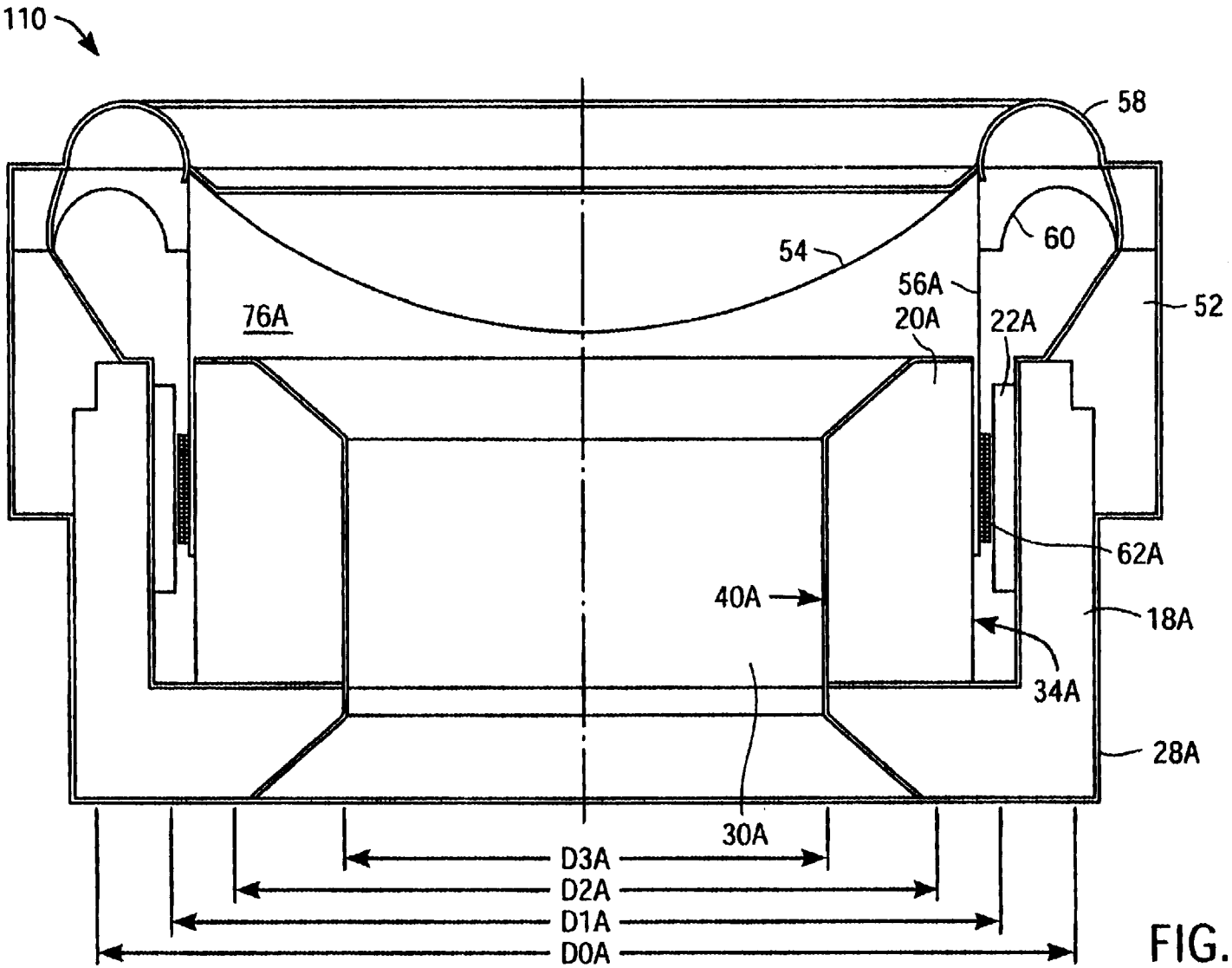
FIG. 3 is a cross-sectional side view of a speaker having an outer magnet construction and an inner coil.

FIG. 3 illustrates a speaker 110 according to an alternative embodiment of the invention wherein magnets 22A are mounted to an internal surface of a casing 18. The speaker 110 has a larger diameter D3A of the inner surface 40A of the pole piece 20A than the inner surface 40 of FIG. 1. A diameter D2A of the outer surface 34A of the pole piece 20A is larger than the outer surface 34 in FIG. 1. A diameter D0A of the outer surface 28A of the case 18A is larger than the outer surface 28 in FIG. 1. A bobbin 56A is similar to the bobbin 56 of FIG. 1, and a coil 62 that is similar to the coil 62 of FIG. 1. All other components are the same or similar to the components of the embodiment of FIG. 1. An advantage of the speaker 110 is that the venting passage 38A is larger than the venting passage 38 in FIG. 1. The venting passage 38 of the speaker 110 is relatively large compared to the dimensions of the enclosure 76A, the bobbin 56A, and a diaphragm 54 thereof. A disadvantage of the speaker 110 is that any modification of the size of the coil 62A requires the magnets 22A and the case 18A to be resized.

Figure 4:
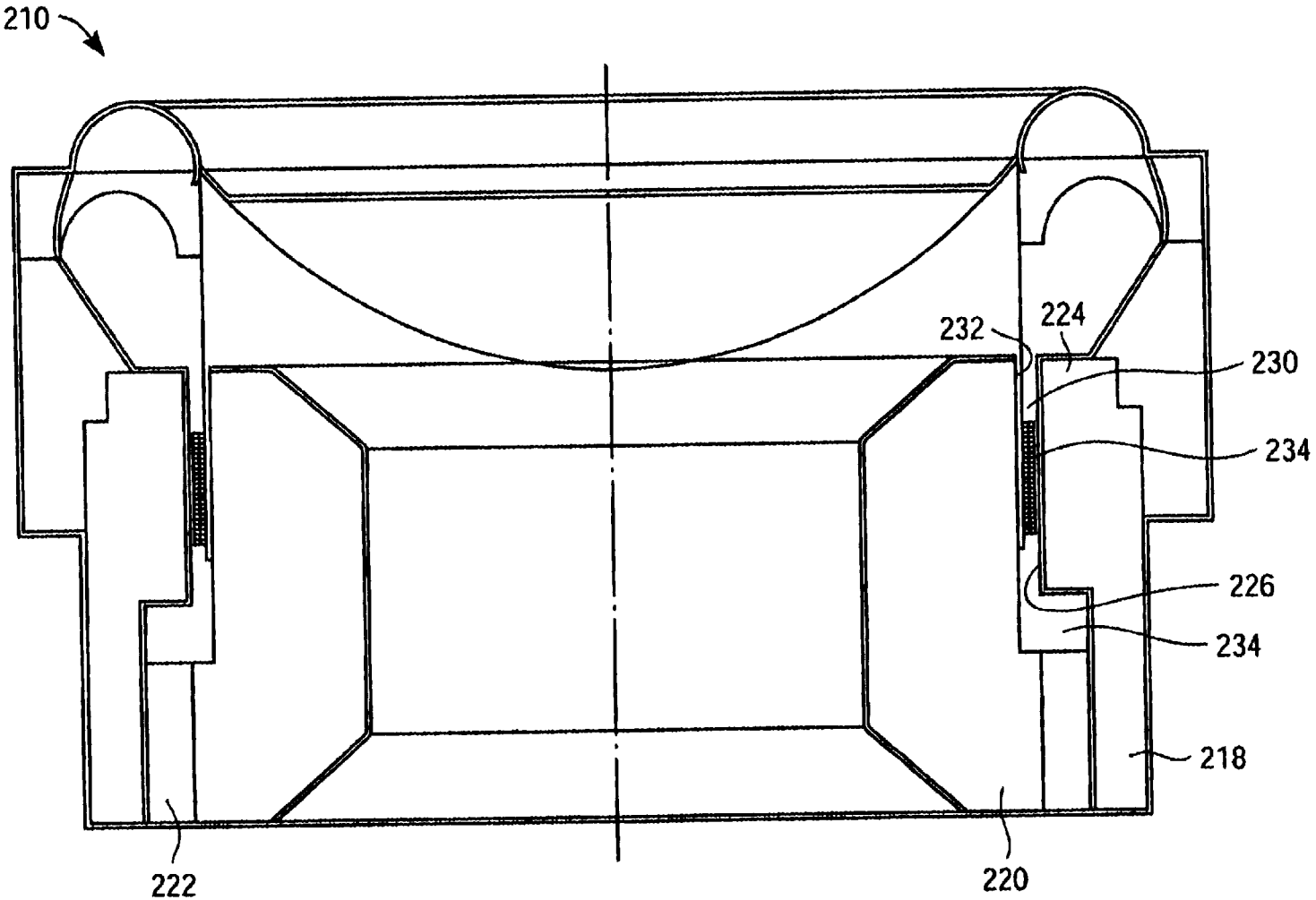
FIG. 4 is a cross-sectional side view of a speaker having a radially magnetized magnet that does not define a coil gap.

FIG. 4 illustrates a speaker 210 according to a further embodiment of the invention. The speaker 210 has an outer casing 218 and an inner pole piece 220. A magnet structure 222 is located in an annular gap between an inner surface of the casing 218 and an outer surface of the pole piece 220. The magnet structure 222 is located against a lower portion of the casing 218 and the lower portion of the pole piece 210.

The casing 218 has an inwardly extending portion 224 forming an inner surface 226. A coil gap 230 is defined between the surface 226 and an outer surface 232 of an upper portion of the pole piece 220. In the present embodiment the coil gap 230 is smaller and located within the dimensions of the magnet structure 222. It should however be understood that the magnet structure may have substantially the same dimensions as the coil gap 230. A coil 234 is located in the coil gap. The coil 234 is attached to a bobbin and other components that vibrate when a sound signal is transmitted through the coil 234. The magnet structure 222 creates lines of magnetic flux which follow closed loops from an outer surface of the magnet structure 222 into a bottom portion of the casing 218, from the bottom portion of the casing 218 to an upper portion of the casing 218, from an upper portion of the casing 218 through the surface 226 across the coil gap 230 to the surface 232, and from the surface 232 down the pole piece 220 to an inner surface of the magnet structure 222. An outermost one of the lines of magnetic flux is entirely located within these components and does not leak outside an outer surface of the casing 218. An inner one of the lines of magnetic flux is also located entirely within these components and follow a path from the surface 226 to the surface 232 without leaking into an area 234 below the coil gap 230.

Figure 5:
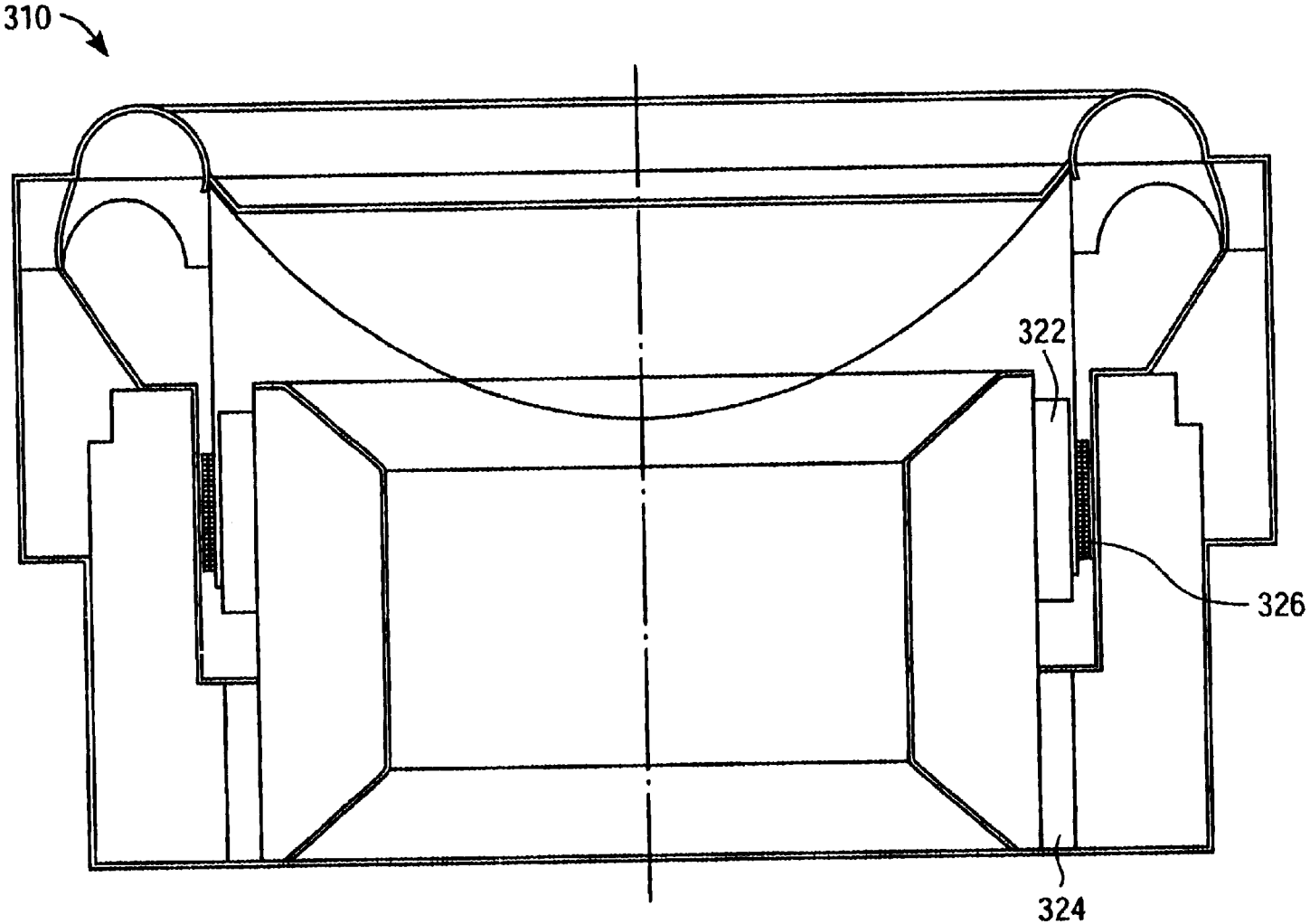
FIG. 5 is a cross-sectional side view of a speaker having one magnet construction defining a coil gap and another magnet construction not defining a coil gap.

FIG. 5 illustrates a speaker 310 according to a further embodiment of the invention. The speaker 310 is essentially a combination of the speaker 110 of FIG. 1 and the speaker 210 of FIG. 4. The speaker 310 has an upper magnet structure 322 and a lower magnet structure 324. The upper magnet structure 322 is similar to the magnet structure 22 of FIG. 1. The lower magnet structure 324 is similar to the magnet structure 222 of FIG. 4, except that it is located within and is smaller than a coil 326. The upper magnet structure 322 may for example have north on the outside and south on the inside and the lower magnet structure may have north on the inside and south on the outside. An advantage of the speaker 310 is that a stronger magnetic field is created, thereby increasing the force on the coil 326.

In an embodiment similar to the embodiment of FIG. 5, the lower magnet structure 324 may have substantially the same diameter as the coil 326.

Although all the aforementioned embodiments have coils that are shorter than coil gaps, it should be understood that the invention is not limited to such embodiments. One further embodiment may for example be where a coil has a length that is longer than a coil gap. The embodiment of FIG. 4 may for example be altered so that the coil gap 230 is short and the coil 234 is long. The embodiment may allow for movement of a diaphragm to a similar degree as hereinbefore described, with at least some coils always remaining in the coil gap, thereby reducing distortion. The advantages of a short coil and long coil gap should however be evident from the aforegoing description.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. A speaker, comprising:

a casing having an inner surface and an outer surface;

a pole piece within the casing, having an outer surface, and an inner surface defining a venting passage therethrough, a substantially annular gap being defined between the inner surface of the casing and the outer surface of the pole piece;

a substantially circular magnet structure in the annular gap, being radially polarized so as to have a first polarity on an inner surface and a second polarity on an outer surface, so as to create a line of magnetic flux following a loop sequentially from the outer surface of the magnet structure to the casing, from the casing to the pole piece, and from the pole piece to the inner surface of the magnet structure, the casing, the pole piece and the magnet structure being mounted to one another to form a magnet assembly which defines an annular coil gap with the path of the loop being across the coil gap;

a diaphragm;

a suspension mechanism having a first portion attached to the magnet assembly and a second portion attached to the diaphragm so as to mount the diaphragm to the suspension mechanism, the suspension mechanism allowing for travel of the diaphragm relative to the magnet assembly, the diaphragm and the suspension mechanism jointly defining at least part of an enclosure;

an electric coil located in the coil gap and having a portion connected to the diaphragm so that an electric current in the coil causes movement of the diaphragm, movement of the diaphragm causing movement of air through the venting passage between the enclosure and externally of the magnet assembly, the travel of the diaphragm being at least 0.1 times a diameter of the diaphragm; and an anti-rocking member having a first portion connected to the magnet assembly and a second portion connected to the diaphragm to limit rocking of the diaphragm relative to the magnet assembly.

2. The speaker of claim 1, wherein the coil gap is defined around the outer surface of the magnet structure.

3. The speaker of claim 1, wherein a side of the coil gap is defined by a surface of the magnet structure.

4. The speaker of claim 3, wherein the coil gap is defined around the outer surface of the magnet structure.

5. The speaker of claim 1, wherein the magnet structure is formed by a plurality of individual magnets.

6. The speaker of claim 1, wherein the first portion of the suspension mechanism is secured to the casing.

7. The speaker of claim 1, wherein a side in the coil gap is defined by an inner surface of the casing and there is substantially no magnetic flux leakage in a loop around an outer surface of the casing.

8. The speaker of claim 1, wherein the coil is shorter than the magnet structure.

9. The speaker of claim 1, wherein the diaphragm is a dome-shaped diaphragm.

10. The speaker of claim 1, further comprising:

a frame secured to the casing, the suspension mechanism being a surround having a first, outer portion secured to the frame and a second, inner portion secured to the diaphragm, and the anti-rocking mechanism being located around the diaphragm and having a first, outer portion connected to the frame and a second, inner portion connected to the diaphragm.

11. The speaker of claim 1, wherein the venting passage at least 0.5 times as wide as the diameter of the coil.

12. The speaker of claim 1, wherein the diaphragm is less than 2 times as wide as the diameter of the coil.

13. A speaker, comprising:

a casing having an inner surface and an outer surface;

a pole piece within the casing, having an outer surface, and an inner surface defining a venting passage therethrough, a substantially annular gap being defined between the inner surface of the casing and the outer surface of the pole piece;

a substantially circular magnet structure in the annular gap, being radially polarized so as to have a first polarity on an inner surface and a second polarity on an outer surface so as to create a line of magnetic flux following a loop sequentially from the outer surface of the magnet structure to the casing, from the casing to the pole piece, and from the pole piece to the inner surface of the magnet structure, the casing, the pole piece and the magnet structure being mounted to one another to form a magnet assembly which defines an annular coil gap with the path of the loop being across the coil gap;

a diaphragm;

a suspension mechanism having a first portion attached to the magnet assembly and a second portion attached to the diaphragm so as to mount the diaphragm to the suspension mechanism, the suspension mechanism allowing for travel of the diaphragm relative to the magnet assembly, the diaphragm and the suspension mechanism jointly defining at least part of an enclosure; and an electric coil located in the coil gap and having a portion connected to the diaphragm so that an electric current in the coil causes movement of the diaphragm, movement of the diaphragm causing movement of air through the venting passage between the enclosure and externally of the magnet assembly, the electric coil having a diameter that is at least 0.5 times as wide as a width of the diaphragm.

14. A speaker, comprising:

a casing having an inner surface and an outer surface;

a pole piece within the casing, having an outer surface, and an inner surface defining a venting passage therethrough, a substantially annular gap being defined between the inner surface of the casing and the outer surface of the pole piece;

a substantially circular magnet structure in the annular gap, being radially polarized so as to have a first polarity on an inner surface and a second polarity on an outer surface so as to create a line of magnetic flux following a loop sequentially from the outer surface of the magnet structure to the casing, from the casing to the pole piece, and from the pole piece to the inner surface of the magnet structure, the casing, the pole piece and the magnet structure being mounted to one another to form a magnet assembly which defines an annular coil gap with the path of the loop being across the coil gap;

a diaphragm;

a suspension mechanism having a first portion attached to the magnet assembly and a second portion attached to the diaphragm so as to mount the diaphragm to the suspension mechanism, the suspension mechanism allowing for travel of the diaphragm relative to the magnet assembly, the diaphragm and the suspension mechanism jointly defining at least part of an enclosure; and an electric coil located in the coil gap and having a portion connected to the diaphragm so that an electric current in the coil causes movement of the diaphragm, movement of the diaphragm causing movement of air through the venting passage between the enclosure and externally of the magnet assembly, a ratio of a length of the coil to a length of the coil gap falling outside the range of from 0.67 to 1.5.

15. The speaker of claim 14, wherein the ratio is less than 0.67.

16. A speaker, comprising:

a casing having an inner surface and an outer surface;

a pole piece within the casing, having an outer surface, and an inner surface defining a venting passage therethrough, a substantially annular gap being defined between the inner surface of the casing and the outer surface of the pole piece;

a substantially circular magnet structure in the annular gap, being radially polarized so as to have a first polarity on an inner surface and a second polarity on an outer surface so as to create a magnetic loop sequentially from the outer surface of the magnet structure to the casing, from the casing to the pole piece, and from the pole piece to the inner surface of the magnet structure, the casing, the pole piece and the magnet structure being mounted to one another to form a magnet assembly which defines an annular coil gap with the path of the loop being across the coil gap;

a dome-shaped diaphragm;

a suspension mechanism having a first portion attached to the magnet assembly and a second portion attached to the diaphragm so as to mount the diaphragm to the suspension mechanism, the suspension mechanism allowing for travel of the diaphragm relative to the magnet assembly, the diaphragm and the suspension mechanism jointly defining at least part of an enclosure; and an electric coil located in the coil gap and having a portion connected to the diaphragm so that an electric current in the coil causes movement of the diaphragm, movement of the diaphragm causing movement of air through the venting passage between the enclosure and externally of the magnet assembly, the diaphragm being less than 2 times as wide as a diameter of the coil, a length of the coil being less than 0.67 times the length of the coil gap, and the air venting passage being at least 0.5 times as wide as the diameter of the coil.

17. A speaker, comprising:

a casing having an inner surface and an outer surface;

a pole piece within the casing, having an outer surface, and an inner surface defining a venting passage therethrough, a substantially annular gap being defined between the inner surface of the casing and the outer surface of the pole piece;

a substantially circular magnet structure in the annular gap, being radially polarized so as to have a first polarity on an inner surface and a second polarity on an outer surface so as to create a magnetic loop sequentially from the outer surface of the magnet structure to the casing, from the casing to the pole piece, and from the pole piece to the inner surface of the magnet structure, the casing, the pole piece and the magnet structure being mounted to one another to form a magnet assembly which defines an annular coil gap with the path of the loop being across the coil gap;

a dome-shaped diaphragm;

a suspension mechanism having a first portion attached to the magnet assembly and a second portion attached to the diaphragm so as to mount the diaphragm to the suspension mechanism, the suspension mechanism allowing for travel of the diaphragm relative to the magnet assembly, the diaphragm and the suspension mechanism jointly defining at least part of an enclosure; and an electric coil located in the coil gap and having a portion connected to the diaphragm so that an electric current in the coil causes movement of the diaphragm, movement of the diaphragm causing movement of air through the venting passage between the enclosure and externally of the magnet assembly, the diaphragm being less than 2 times as wide as a diameter of the coil, the travel of the diaphragm being at least 0.1 times a diameter of the diaphragm, the length of the coil being less than 0.67 times the length of the coil gap, and the air venting passage being at least 0.5 times as wide as the diameter of the coil.

* * * * *